US006161416A

United States Patent [19]

Wilhelm et al.

[11] Patent Number: 6,161,416

[45] Date of Patent: Dec. 19, 2000

[54] TOOL FOR CRIMPING CONTACT ELEMENTS

[75] Inventors: Edgar Wilhelm, Altersbach; Horst Hofmann, Unterschoenau, both of Germany

[73] Assignee: Rennsteig Werkzeuge GmbH, ViernauThueringen, Germany

[21] Appl. No.: 09/334,295

[22] Filed: Jun. 16, 1999

[51] Int. Cl.[7] ..... H01R 43/042

[52] U.S. Cl. ..... 72/409.08; 72/409.12; 81/367; 81/373

[58] Field of Search ..... 72/409.08, 409.12, 72/409.01; 81/355, 373, 367, 376

[56] References Cited

U.S. PATENT DOCUMENTS

| | | | |
|---|---|---|---|
| 704,217 | 7/1902 | Sarr | 72/409.01 |
| 1,363,949 | 12/1920 | Zuckerman | 72/409.01 |
| 2,430,383 | 11/1947 | Yager | 72/409.01 |
| 2,696,747 | 12/1954 | Bergan | 72/409.12 |
| 2,743,643 | 5/1956 | Badeau | 81/376 |
| 2,825,525 | 3/1958 | Kellam | 81/367 |
| 3,195,382 | 7/1965 | Rommel | 81/373 |
| 3,379,079 | 4/1968 | Cutter | 81/367 |
| 4,051,710 | 10/1977 | Kobayashi | 72/409.01 |
| 5,138,864 | 8/1992 | Tarpill | 72/409.12 |

FOREIGN PATENT DOCUMENTS

| | | | |
|---|---|---|---|
| 515919 | 9/1954 | Belgium | 72/409.01 |
| 513815 | 2/1921 | France | 72/409.01 |

*Primary Examiner*—Daniel C. Crane
*Attorney, Agent, or Firm*—Michael J. Striker

[57] ABSTRACT

A tool for crimping contact elements of electrical conductors and formed as pliers has main levers, pressing or mouth jaws which are formed on the main levers and closed in an effective region parallel, handles operative for bringing the pressing or mouth jaws to an opening position and also to a closing or pressing position, the both main levers which carry the pressing and mouth jaws being formed each as a one-arm lever which has an end opposite to the pressing and mouth jaws, a hinge pin turnably connecting the one-arm levers with one another at the ends, and an actuating lever associated with a movable main lever, formed as an angular lever and supported in an arm part of the immovable main lever, the actuating lever being drivingly connected with the movable main lever in a region of its pressing end mouth jaw via a lever element.

9 Claims, 1 Drawing Sheet

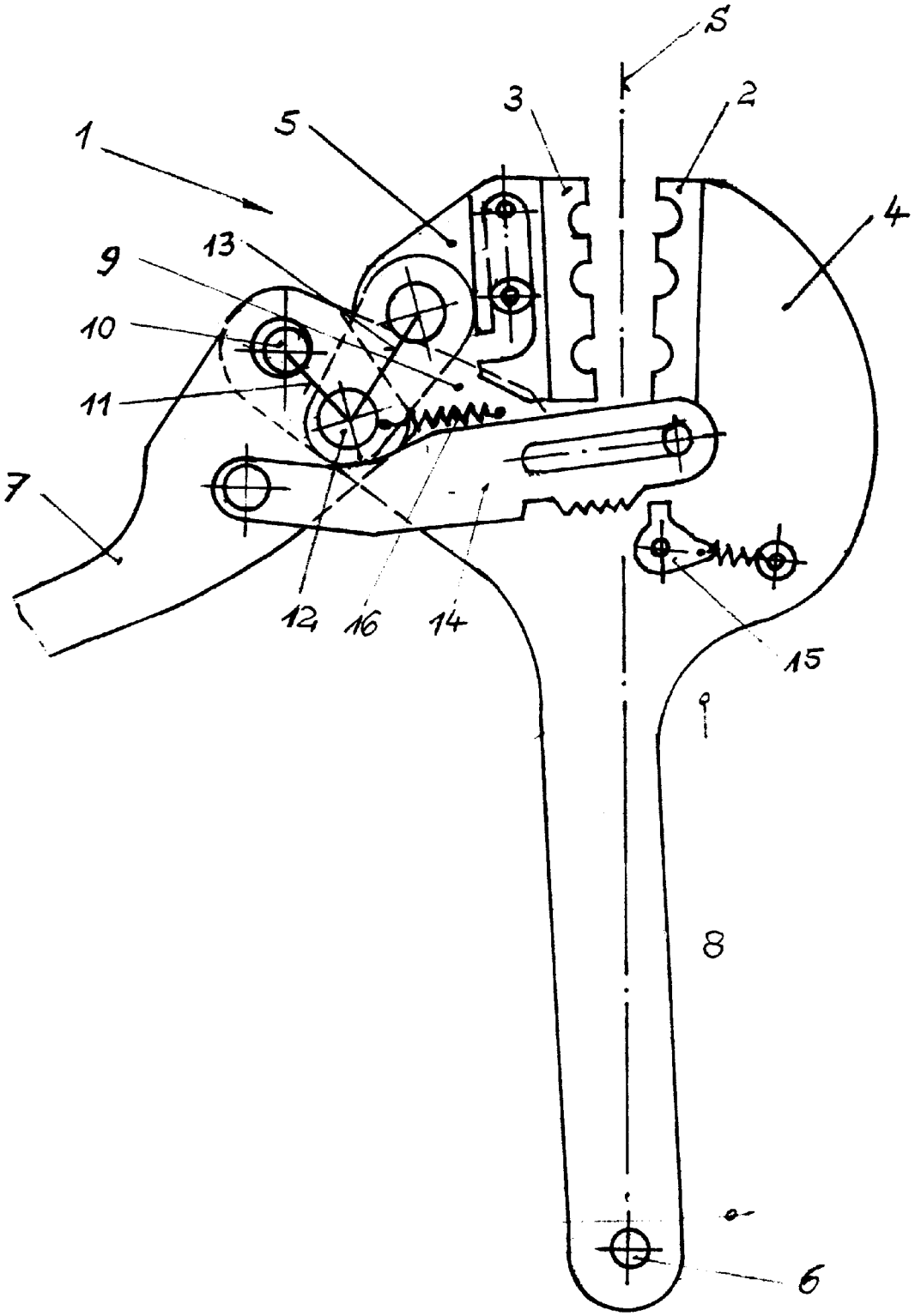
S
3
2
1
5
4
13
9
10
11
7
12
16
14
15
8
6

TOOL FOR CRIMPING CONTACT ELEMENTS

BACKGROUND OF THE INVENTION

The present invention relates to a tool for crimping contact elements on electrical conductors, in particular a crimping tool with pressing or mouth jaws.

Pressing tools for crimping of contact elements, such as contact bushes, cables shoes and sleeve connectors are known in different embodiments and have been used for many years. They have pressing or mouth jaws which are beak-shaped or are closed parallel and carry a pressing profile. They are brought to closing and pressing position by means of their handles.

In view of the fact that with the beak-shaped closing pressing and mouth jaws there are disadvantages of partially incomplete or non uniform crimping of both contact parts and in view of the increasing demands in the consumer industry for the quality of the pressing connections produced with such tools, there is lately a tendency to improvement of the pressing technique. As a result, tools are utilized which have pressing or mouth jaws movable parallel to one another. When the tools of this type are utilized, an efficient crimping can be provided with an optimal efficient flat contact between both parts to be joined. The pressing tools of this type has however the disadvantage with regard to the pressing or mouth jaws closeable in a beak-like manner, in that the design of their active tool elements, the pressing jaw arrangement and their guidance involve high structural expenses to convert the pliers-like working movement of the handle pair over the lever pivot point into a parallel closing movement of the pressing jaws.

For example, there is a known pliers design of this type, which includes the mouth jaws operating as a pressing plunger which is directly associated in a specific mouth jaw serving as a pressing die. In otherwords, with the spacially fixedly arranged guide it is slidingly movably received, and its head part is pivotably supported on another tongue lever for transmission of the applied pressing forces. This design is basically acceptable for simple parallel crimping. However, it is usable only conditionally for completely responsive, reliably operating and functionally complete crimping works, since this type of pressing plunger receptacle and the guidance of the same under the action of the pressing forces frequently do not satisfy all requirements.

Another known parallel pressing pliers are designed with a toggle leverdrive because of the availability of relatively high pressing forces. It includes a lever which is directly pivotably connected with a cylindrically guided pressing plunger movable parallel on the pressing die. This solid construction of this type tool leaves plenty to be desired in the functional sense. The tool is relatively heavy because of the required stability and therefore is difficult to handle, which condition can be compensated only partially by simple and fast exchangeable pressing jaws.

Generally speaking it has been found that with both above mentioned tool construction the structural and manufacturing advantageous properties step to certain degree are overshadowed by different disadvantages in functional aspects, and visa versa. While with the beak-shaped closing pressing and mouth jaws the advantage is provided with respect to the applied pressing forces which can be adjusted with simple means to the corresponding required force consumption by arranging the great pressing cross-section directly at the tool hinge and by placing and arranging the smaller pressing cross-sections due to the non equal smaller force consumption after the mouth opening, in the tools with the parallel closing pressing and mouth jaws this is disadvantageous. Therefore such a manipulation of the applied pressing forces is excluded, since the forces applied in the force-transmitting system of this type of tool at each point of the pressing or mouth jaws act with the same magnitude. Moreover, the parallel closing movement realized with this tool type with respect to the design of the uniform pressing in the total shaping region, in particular in the case of 6-edge and roll pressing provides advantageous results, since here differently dimensioned working or pressing strokes can not occur in the region of the individual pressing forms and thereby the form non-uniformities are reliably prevented.

In practice, there is however no tool which can combine the advantages of both types of tools, and at the same time can be produced in a simple and cost-favorable manner and also provide identically great pressing forces.

SUMMARY OF THE INVENTION

Accordingly, it is an object of the present invention to provide a tool for crimping contact elements, which avoids the disadvantages of the prior art.

More particularly, it is an object of the present invention to provide a tool for crimping contact elements which takes into considerations the above mentioned disadvantages of the existing tools and provides corresponding advantages to satisfy the requirements of a consumer.

More particularly, it is an object of the present invention to provide a tool which is formed as pliers for parallel crimping of contact elements or electrical conductors by pressing jaws which close parallel to one another, in which its parts have a simple shape and are easy to manufacture, its actuation is performed in a conventional way but with improved efficiency, its hinge for closing action of the pressing jaws provides a fully efficient force deployment and force transmission adjusted to shaping conditions.

In keeping with these objects and with others which will become apparent hereinafter, one feature of present invention resides, briefly stated, in a tool for crimping contact elements on electrical conductors, in which both main levers which carry pressing and mouth jaws are each formed as a one-arm lever and are turnably connected with one another by a hinge pin at their ends facing away from the pressing or mouth jaws, and a special actuating lever which is formed as an angular lever and supported in an arm part of one main lever is associated with the movable main lever, and the actuating lever is connected with the movable main lever in the region of its pressing or mouth jaws drivingly via a lever member.

When the pliers-shaped pressing tool is formed in accordance with the present invention, the parallel closing of both pressing jaws obtained with simple means advantageously provides for desired, functionally complete shaping effect of the corresponding contact elements. Moreover, in the course of the closing movement, of the relatively movable handle leg, the applied manual force can be adjusted to the shape and/or material-required shaping conditions. An efficient crimping on all pressing locations is guaranteed with relatively low force introduction.

The comparable types of pliers can not achieve these complete responsive functional and application-technical properties.

A further advantage of the tool in accordance with the present invention is that it provides for simplified, and thereby cost-favorable manufacture of the parts, including their mounting and adjustment.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view showing a tool for crimping contact elements in accordance with the present invention, in an open condition of a tool lever.

DESCRIPTION OF PREFERRED EMBODIMENTS

A crimping tool in accordance with the present invention is formed as crimping pliers identified with reference numeral 1. The tool has two main levers 4 and 5 which carry pressing or mouth jaws 2 and 3. The levers 4 and 5 are turnably connected with one another in the region of their end portions which face away from the pressing or mouth jaws 2. The connection is performed by a hinge pin 6 so that the levers 4 and 5 are movable to close and to open in a beak-like manner. The hinge pin 6 is located on an axis of symmetry S formed between the both pressing or mouth jaws 2 and 3.

The lever 4 which carries the pressing and mouth jaw 2 is provided as a relatively stationary part, while the lever 5 which carries the pressing or mouth jaw 3 must be formed as a movable part. The pressing or mouth jaws 2 and 3 have active surfaces which face toward one another and are provided with a pressing profile of a conventional shape and size. The pressing profile is preferably arranged on exchangeable jaw inserts.

It can be seen that because of the relatively great distance of the hinge pin 6 from the pressing or mouth jaws 2 and 3, their opening and closing movement is approximately parallel. Therefore, no longer a beak-like closing movement is performed, but instead a parallel pressing is performed in the sense of pressing technique. It is advantageous that the pressing or mouth jaws 2 and 3 which in principle are moved beak-like closingly in their profiled working region can reach shaping or pressing forces which have different magnitudes from behind forwardly. This condition is narrowly welcomed in the pressing technique, since it substantially determines the universality of the tool.

The pliers-like handling and activation of the tool effective location directed for crimping of the contact elements is provided in the region of the pressing profile in a way which is known in principle. In particular, the movable lever 5 is moved to the stationary lever 4. This movement is provided by an actuating lever 7, which together with both main levers 4 and 5 connected in the gripping region 8 form the other of the two handles of the crimping tool.

The actuating lever 7 is supported in an arm part 9 of the lever 4 on a pin 10 which is simultaneously formed as an adjusting eccentric. It forms, with its lever arm 11 extending to a neighboring hinge pin 12 in which simultaneously a stroke lever 13 is supported, a first part of a toggle lever. The second part of the toggle lever is pivotably connected with movable lever 5 through the stroke lever 13.

It can be clearly seen that during closing of the actuating lever 7, the toggle lever after its extending position is moved and in the course of this movement the main lever 5 and together with this the pressing or mouth jaws 3 are moved to the pressing position. For automatic control, as to whether the corresponding crimping is completely performed, a lock which operates in a known manner is provided. In particular, it is composed of a locking lever 13 and a locking catch 15. It makes controllable the relative position between the actuating lever as a closing element and the fixed pressing or mouth jaw 2.

In accordance with a preferable embodiment of the invention, the pin 10 is formed as an adjusting eccentric pin for adjusting the effective extension of the toggle lever drive within certain limits, preferably from outside, by turning of the pin 10. Thereby a simple and at the same time targeted possibility is provided to perform post adjustments with regard to the closing position of the pressing or mouth jaws which are required due to different materials.

In accordance with a further preferable embodiment of the inventive tool, a spring 16 is arranged on the stroke lever 13 and acts on the actuating lever 7 with a pulling force. It is located between the actuating lever 7 and the movable main lever 5. The spring 16 facilitates opening of the pliers members.

It will be understood that each of the elements described above, or two or more together, may also find a useful application in other types of constructions differing from the types described above.

While the invention has been illustrated and described as embodied in tool for crimping contact elements, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A tool for crimping contact elements of electrical conductors and formed as plyers, the tool comprising pressing or mouth jaws which has crimping faces extending in a first direction and are movable relative to one another in a second direction which is transverse to said first direction between an opening position and a closing or pressing position so as to close in said closing position with said surfaces parallel to one another in an effective region; two main levers which carry said jaws and are each formed as a one-arm lever and each having an arm part on which a respective one of said jaws is formed and a gripping part which extends from said arm part in said first direction and has an end opposite to said arm part; a hinge pin turnably connecting said main levers with one another at said end of said gripping part which is opposite to said arm part, so that main levers perform a beak-like movement while said jaws perform a parallel pressing, said main levers including a movable lever and an immovable lever; and an actuating lever which is supported in said arm part of said immovable main lever and is drivingly connected with said moveable main lever in a region of its pressing or mouth jaw directly adjacent to said crimping faces.

2. A tool as defined in claim 1, wherein said gripping parts of said main levers form a joint gripping region, said actuating lever having a gripping part which forms another gripping region.

3. A tool as defined in claim 1, wherein said hinge pin is arranged on an axis of symmetry formed between said pressing and mouth jaws.

4. A tool as defined in claim 1, wherein said actuating lever has a bearing point which is formed as a pin, said pin being formed as an adjusting eccentric.

5. A tool as defined in claim 1; and further comprising a locking lever which is arranged on said actuating lever and is drivingly connected with the latter, said locking lever acting in an actuating direction of said actuating lever; and a locking catch arranged on said immovable main lever, said locking lever being in operative connection with said locking catch until a crimping is completely performed and a form-locking connection of a lock is removed.

6. A tool as defined in claim 1; and further comprising a stroke lever and a spring located between said actuating lever and said movable main lever, said spring acting with a pulling force on said actuating lever and engaging said stroke lever.

7. A tool as defined in claim 1, wherein said actuating lever is formed as an angular lever.

8. A tool as defined in claim 1; and further comprising a lever element through which said actuating element is drivingly connected with said movable main lever.

9. A tool for crimping contact elements of electrical conductors and formed as plyers, the tool comprising pressing or mouth jaws which has crimping faces with a pressing profile extending in a first direction and are movable relative to one another in a second direction which is transverse to said first direction between an opening position and a closing or pressing position so as to close in said closing position with said surfaces parallel to one another in an effective region; two main levers which carry said jaws and are each formed as a one-arm lever and each having an arm part on which a respective one of said jaws is formed and a gripping part which extends from said arm part in said first direction and has an end opposite to said arm part; a hinge pin turnably connecting said main levers with one another at said end of said gripping part which is opposite to said arm part, so that main levers perform a beak-like movement while said jaws perform a parallel pressing, said main levers including a movable lever and an immovable lever; and an actuating lever which is supported in said arm part of said immovable main lever and is drivingly connected with said moveable main lever in a region of its pressing or mouth jaw, said arm part of said immovable main lever being located opposite to said jaws and receiving and supporting said actuating lever, said actuating lever being connected with said movable main lever through a toggle element with a pin so that a pressing force is applied substantially in a central region of said pressing profile of said jaws, said pin being formed as an adjusting eccentric pin.

* * * * *